US011882945B2

(12) United States Patent
Xiao et al.

(10) Patent No.: US 11,882,945 B2
(45) Date of Patent: Jan. 30, 2024

(54) CHILD CRIB

(71) Applicant: WONDERLAND SWITZERLAND AG, Steinhausen (CH)

(72) Inventors: Lei Xiao, Guangdong (CN); Bo Wu, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 17/586,314

(22) Filed: Jan. 27, 2022

(65) Prior Publication Data

US 2022/0240691 A1 Aug. 4, 2022

(30) Foreign Application Priority Data

Feb. 4, 2021 (CN) ..... 202110155200.4

(51) Int. Cl.
*A47D 9/00* (2006.01)

(52) U.S. Cl.
CPC ..... *A47D 9/00* (2013.01)

(58) Field of Classification Search
CPC .... A47D 13/06; A47D 13/061; A47D 13/063; A47D 13/066; A47D 13/068
See application file for complete search history.

(56) References Cited

U.S. PATENT DOCUMENTS 6,430,762 B1 8/2002 Cheng
9,149,128 B2 * 10/2015 Rampton ..... A47D 13/063
9,801,473 B2 10/2017 Jackson et al.
2009/0077741 A1 * 3/2009 Burns ..... A47D 13/063 5/98.1
2014/0068857 A1 3/2014 Jackson et al.

FOREIGN PATENT DOCUMENTS

CN 2794341 Y * 7/2006 ..... A47D 13/066
CN 201147078 Y 11/2008
CN 203633856 U 6/2014
CN 205083095 U 3/2016
GB 2456021 A 7/2009
GB 2456021 B 2/2012
WO WO-2016130361 A1 * 8/2016 ..... A47D 15/008

* cited by examiner

*Primary Examiner* — Justin C Mikowski
*Assistant Examiner* — Adam C Ortiz
(74) *Attorney, Agent, or Firm* — HAUPTMAN HAM, LLP

(57) ABSTRACT

A child crib includes a frame body, a corner component, a cloth component and a covering member. The cloth component at least partially covers the frame body. The corner component is connected to a handrail and a post of the frame body and exposed out of the cloth component. A first ring-shaped opening structure and a second ring-shaped opening structure are respectively formed by a first side and a second side of a covering body of the covering member. When the first side of the covering body is connected to a first side of the cloth component, by positioning the second side of the covering body on a second side of the cloth component, the first side and the second side of the cloth component are respectively enclosed by the first ring-shaped opening structure and the second ring-shaped opening structure, and the covering member covers the corner component.

11 Claims, 10 Drawing Sheets

CHILD CRIB

BACKGROUND

1. Technical Field

The present disclosure relates to a child crib, and more specifically, to a child crib with enhanced using safety.

2. Description of the Prior Art

A child crib is a child product which can provide an independent space for allowing a child to sleep or play therein safely. A frame body of the child crib usually includes handrails, posts and connecting components, so that each of the handrails and each of the posts can be connected to each other by the corresponding connecting component. However, due to assembly errors, there is a gap between the handrail and the connecting component and/or a gap between the post and the connecting component, and therefore, it often happens that the child is injured due to insertion of the child's finger into the gap.

SUMMARY

The present disclosure discloses a child crib. The child crib includes a frame body, a corner component, a cloth component and a covering member. The frame body includes a handrail and a post. The corner component is connected to the handrail and the post. The cloth component at least partially covers the frame body. The corner component is exposed out of the cloth component. The covering member includes a covering body. The covering body includes a first side, a second side, a third side and a fourth side. The first side of the covering body is opposite to the second side of the covering body. The third side of the covering body is adjacent to the first side and the second side of the covering body. The fourth side of the covering body is adjacent to the first side and the second side of the covering body and opposite to the third side of the covering body. The third side of the covering body is connected to the fourth side of the covering body, so that a first ring-shaped opening structure and a second ring-shaped opening structure are respectively formed by the first side of the covering body and the second side of the covering body. When the first side of the covering body is connected to a first side of the cloth component, by positioning the second side of the covering body on a second side of the cloth component, the first side and the second side of the cloth component are respectively enclosed by the first ring-shaped opening structure and the second ring-shaped opening structure, and the covering member covers the corner component.

The present disclosure further discloses a child crib. The child crib includes a frame body, a corner component a cloth component and a covering member. The frame body includes a handrail and a post. The corner component is connected to the handrail and the post. The cloth component at least partially covers the frame body. The corner component is exposed out of the cloth component. The covering member includes a covering body and a connecting assembly. The covering body includes a first side and a second side. The first side of the covering body is opposite to the second side of the covering body. The connecting assembly is configured to detachably position the second side of the covering body on a second side of the cloth component. When the first side of the covering body is connected to a first side of the cloth component, the covering member covers the corner component by detachably positioning the second side of the covering body on the second side of the cloth component. The connecting assembly includes a first combining structure disposed on the second side of the covering body. The post includes a second combining structure disposed on a portion of the post exposed out of the cloth component. The second combining structure is configured to detachably combine with the first combining structure, so as to detachably position the second side of the covering body on the second side of the cloth component.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the disclosure may be practiced. In this regard, directional terminology, such as "top", "bottom", "left", "right", "front", "back", etc., is used with reference to the orientation of the Figure(s) being described. The components of the present disclosure can be positioned in a number of different orientations. As such, the directional terminology is used for purposes of illustration and is in no way limiting. Accordingly, the drawings and descriptions will be regarded as illustrative in nature and not as restrictive. Also, the term "couple" or "connect" is intended to mean either an indirect or direct mechanical connection. Thus, if a first device is connected to a second device, that connection may be through a direct mechanical connection, or through an indirect mechanical connection via other devices and connections.

Figure 1:
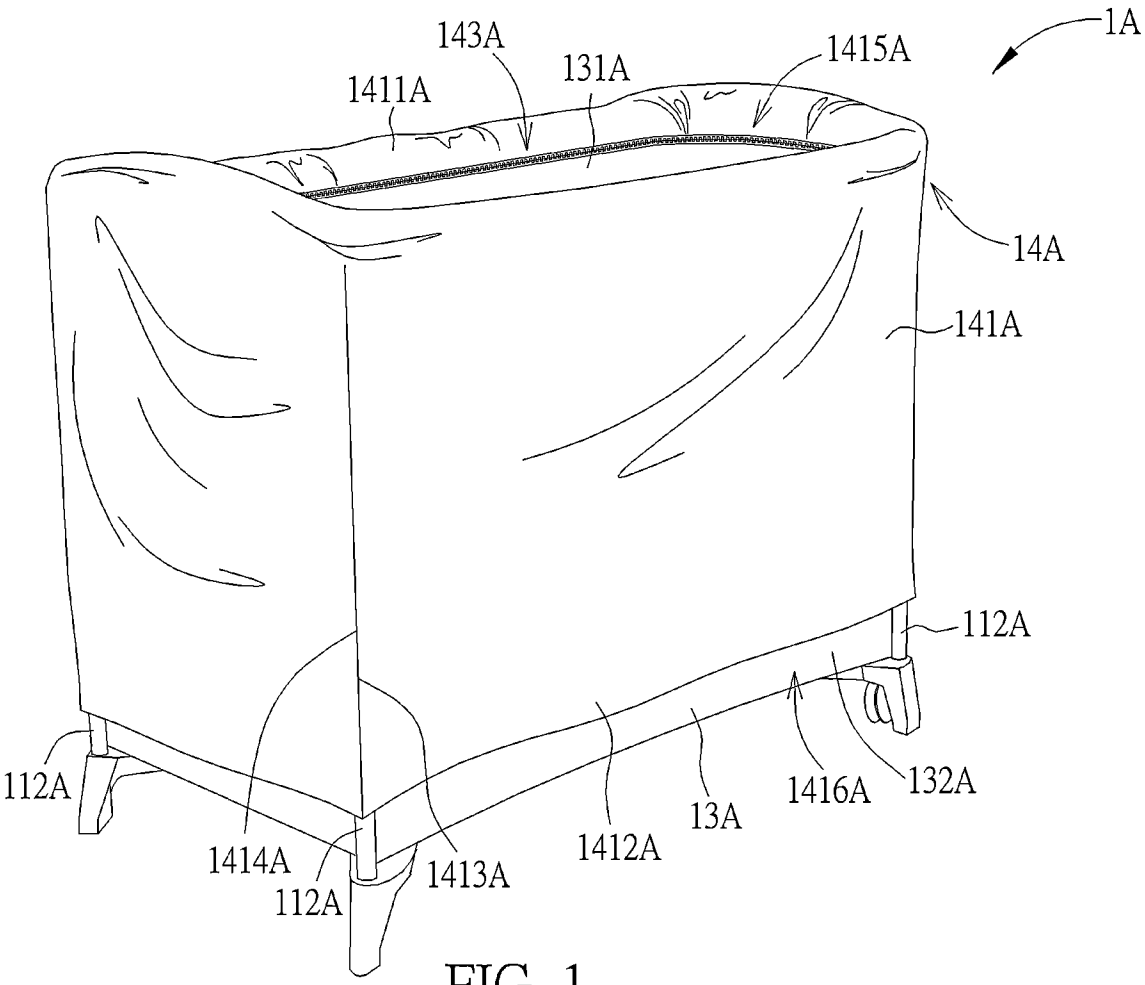
FIG. 1 to FIG. 3 are diagrams of a child crib in different states according to an embodiment of the present disclosure.
Figure 2:
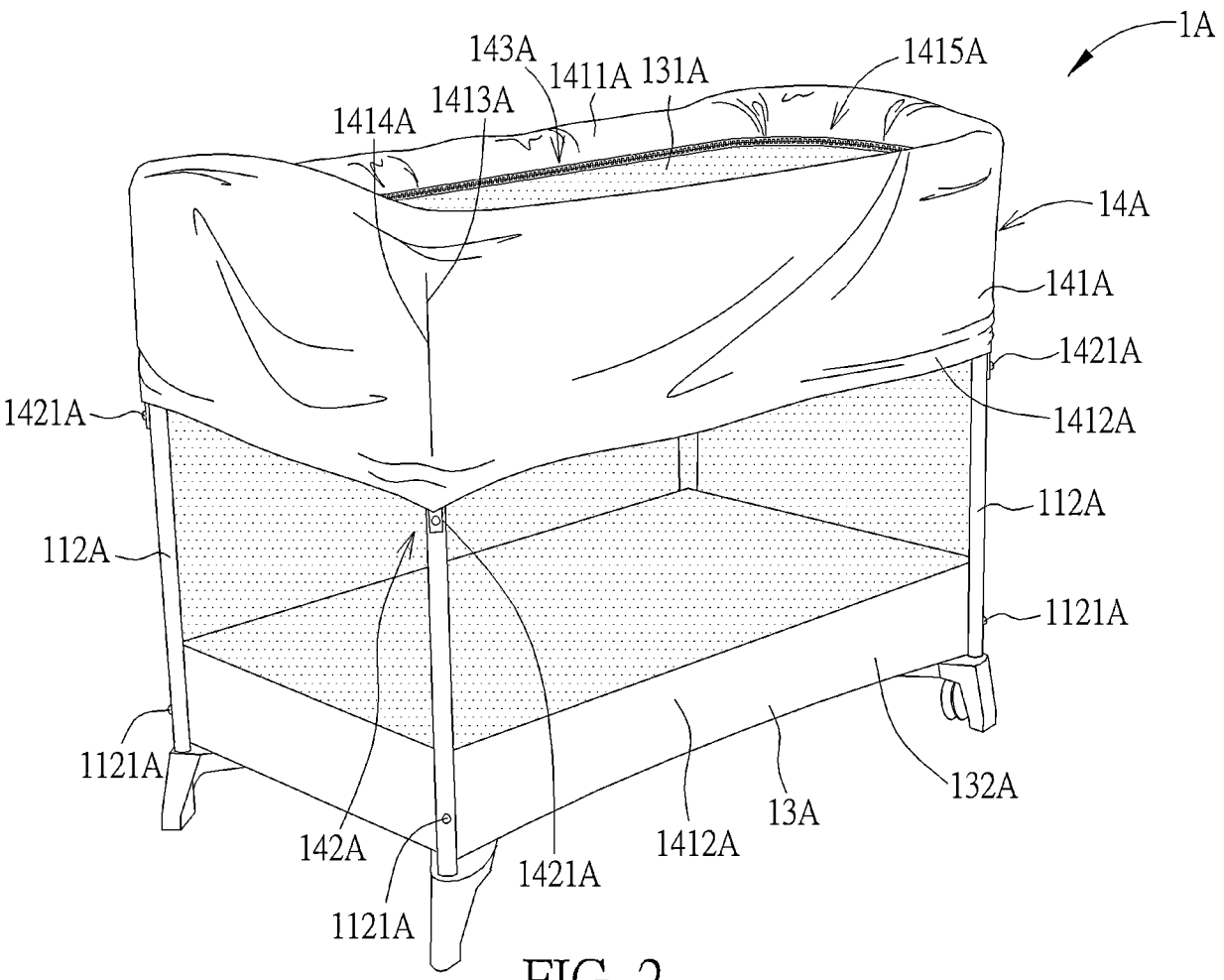
Figure 3:
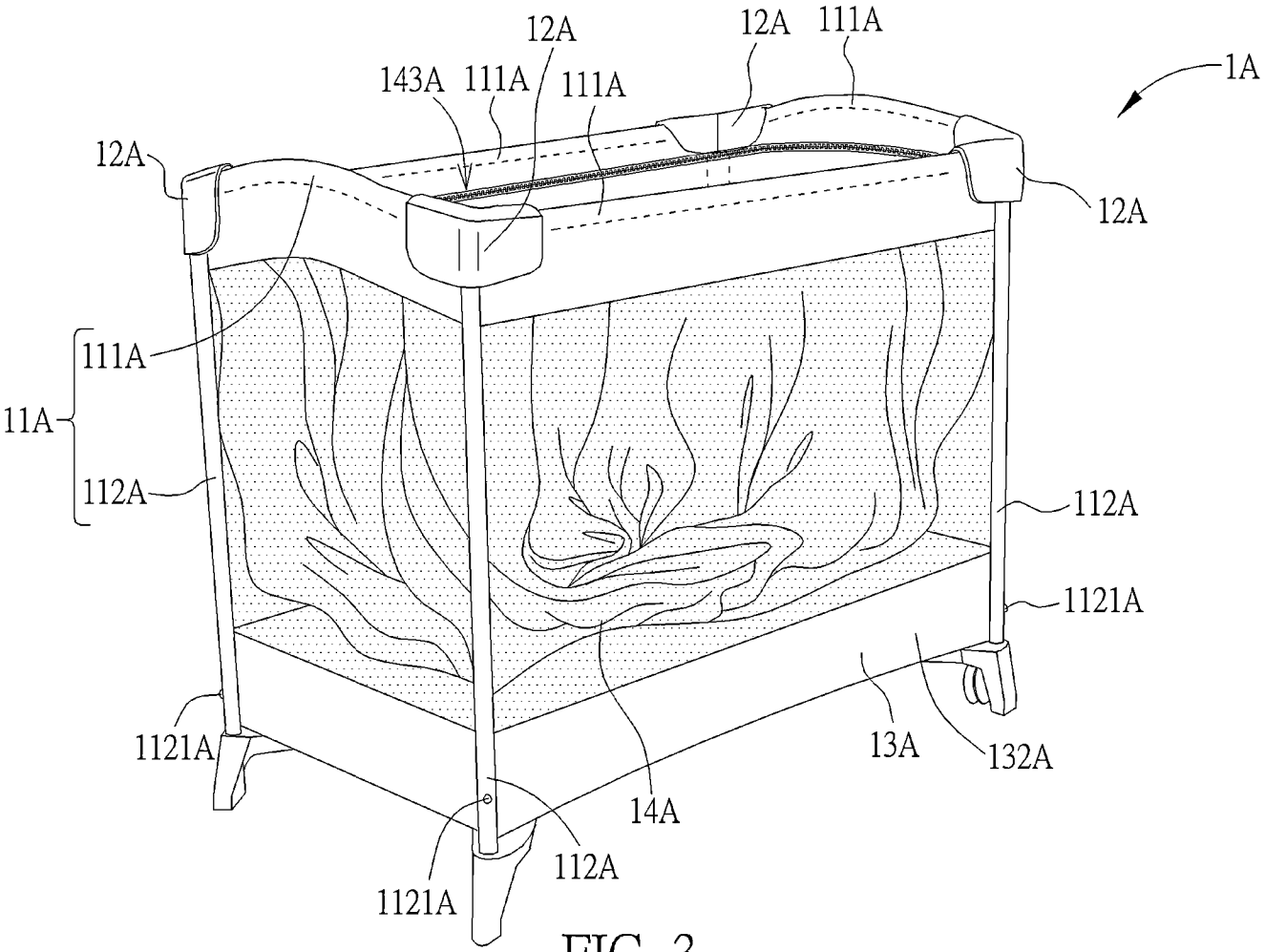

Please refer to FIG. 1 to FIG. 3. FIG. 1 to FIG. 3 are diagrams of a child crib 1A in different states according to an embodiment of the present disclosure. As shown in FIG. 1 to FIG. 3, the child crib 1A includes a frame body 11A, four corner components 12A, a cloth component 13A and a covering member 14A. The frame body 11A includes four handrails 111A and four posts 112A. Each of the corner components 12A is fixedly connected to the corresponding handrail 111A and the corresponding post 112A and located at a corresponding one of four upper corners of the frame body 11A. The cloth component 13A at least partially covers the frame body 11A. Each of the corner components 12A is exposed out of the cloth component 13A. The covering member 14A is configured to cover the four corner components 12A for preventing insertion of the child's finger into a gap between each of the corner components 12A and the corresponding handrail 111A and a gap between each of the corner components 12A and the corresponding post 112A. Therefore, the present disclosure has enhanced using safety.

In this embodiment, as shown in FIG. 3, the four handrails 111A are arranged to form a rectangular structure. The four corner components 12A are respectively located at four corners of the rectangular structure, and each of the corner components 12A is connected to the two corresponding handrails 111A and the corresponding post 112A. However, the numbers and the configurations of the handrail, the corner component and the post are not limited to this embodiment. It depends on practical demands. For example, in another embodiment, the child crib can include only one handrail integrally formed and in an ellipse shape, one post and one corner component movably connected to the handrail and the post.

Besides, as shown in FIG. 1 to FIG. 3, the covering member 14A includes a covering body 141A. The covering body 141A includes a first side 1411A, a second side 1412A, a third side 1413A and a fourth side 1414A. The first side 1411A and the second side 1412A of the covering body 141A are opposite to each other. The third side 1413A of the covering body 141A is adjacent to the first side 1411A and the second side 1412A. The fourth side 1414A of the covering body 141A is adjacent to the first side 1411A and the second side 1412A and opposite to the third side 1413A. The third side 1413A and the fourth side 1414A of the covering body 141A are connected to each other, so that a first ring-shaped opening structure 1415A and a second ring-shaped opening structure 1416A are respectively formed by the first side 1411A and the second side 1412A of the covering body 141A. When the first side 1411A of the covering body 141A is connected to a first side 131A, i.e., an inner side, of the cloth component 13A, by positioning the second side 1412A of the covering body 141A on a second side 132A, i.e., an outer side, of the cloth component 13A, the first side 131A and the second side 132A of the cloth component 13A are respectively enclosed by the first ring-shaped structure 1415A and the second ring-shaped structure 1416A, and the covering member 14A covers the four corner components 12A.

The covering member 14A further includes a connecting assembly 142A and a linking assembly 143A. The connecting assembly 142A is configured to detachably position the second side 1412A of the covering body 141A on the second side 132A of the cloth component 13A. The linking assembly 143A is configured to detachably couple the first side 1411A of the covering body 141A to the first side 131A of the cloth component 13A.

Figure 4:
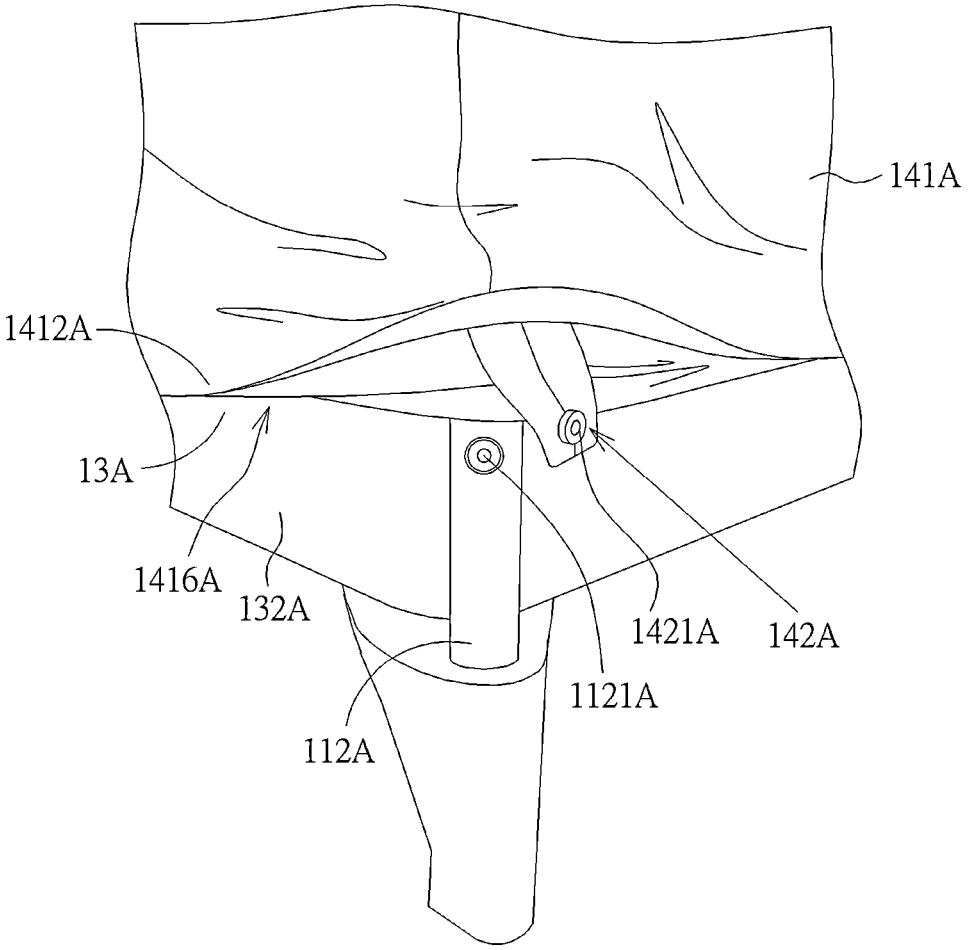
FIG. 4 is a partial diagram of the child crib according to the embodiment of the present disclosure.

Specifically, please refer to FIG. 1 to FIG. 4. FIG. 4 is a partial diagram of the child crib 1A according to the embodiment of the present disclosure. As shown in FIG. 1 to FIG. 4, in this embodiment, the connecting assembly 142A includes four first combining structures 1421A. The four first combining structures 1421A are disposed on the second side 1412A of the covering body 141A and located at positions respectively corresponding to the four posts 112A. Each of the posts 112A includes a second combining structure 1121A. Each of the second combining structures 1121A is disposed on a portion of the corresponding post 112A exposed out of the second side 132A of the cloth component 13A. Each of the second combining structures 1121A is configured to detachably combine with the corresponding first combining structure 1421A, so as to detachably position the second side 1412A of the covering body 141A on the second side 132A of the cloth component 13A. As shown in FIG. 4, the first combining structure 1421A and the second combining structure 1121A can respectively be a first buckle and a second buckle which can be buckled with each other, e.g., the first combining structure and the second combining structure can respectively be a female buckle and a male buckle. However, the present disclosure is not limited thereto. The combining mechanism of the first combining structure and the second combining structure of the present disclosure is not limited to any form. For example, in another embodiment, the first combining structure and the second combining structure can respectively be a first Velcro tape and a second Velcro tape which can be adhered to each other, e.g., the first combining structure and the second combining structure can respectively be a female Velcro tape and a male Velcro tape. Alternatively, in another embodiment, the first combining structure and the second combining structure can respectively be a first engaging structure and a second engaging structure which can be engaged with each other, e.g., the first combining structure and the second combining structure can respectively be an engaging hole and an engaging hook. Besides, in another embodiment, there can be only one first combining structure and one second combining structure.

Figure 5:
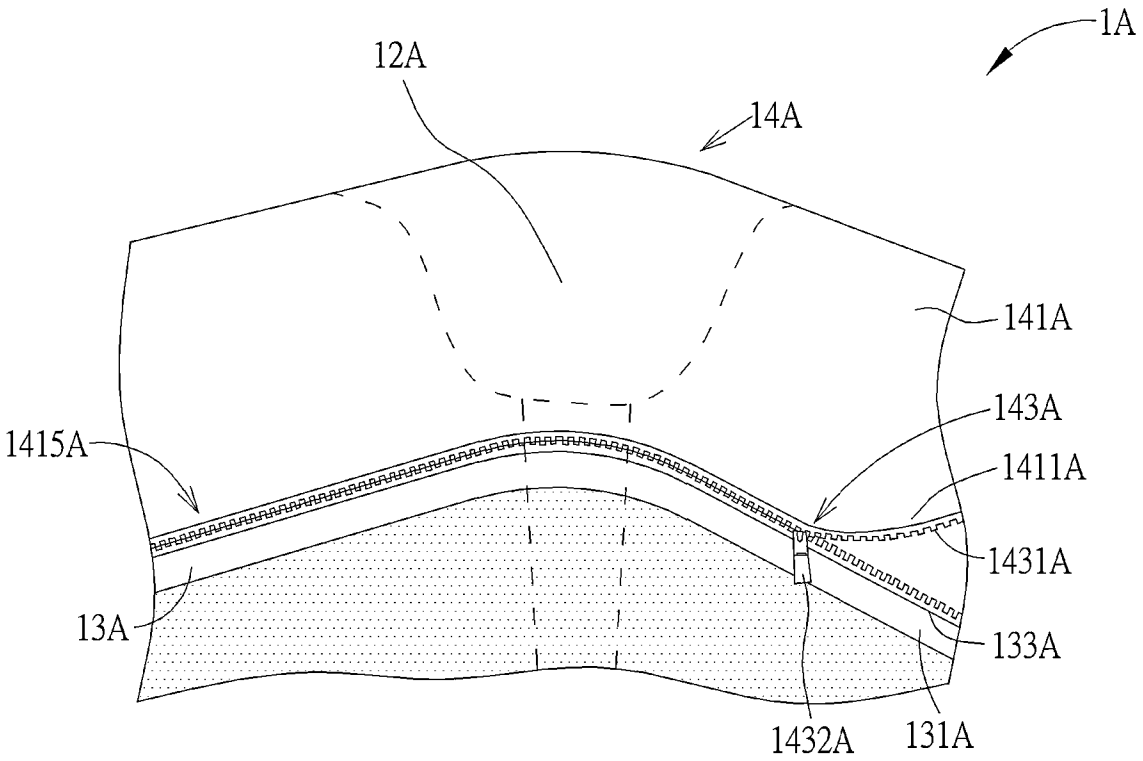
FIG. 5 is another partial diagram of the child crib according to the embodiment of the present disclosure.

Furthermore, please refer to FIG. 1 to FIG. 3 and FIG. 5. FIG. 5 is another partial diagram of the child crib 1A according to the embodiment of the present disclosure. As shown in FIG. 1 to FIG. 3 and FIG. 5, the linking assembly 143A includes a first zipper element 1431A and a zipper connector 1432A. The first zipper element 1431A is disposed on the first side 1411A of the covering body 1411A. The cloth component 13A includes a second zipper element 133A disposed on the first side 131A of the cloth component 13A. The zipper connector 1432A is configured to drive the first zipper element 1431A to engage with the second zipper element 133A for coupling the first side 1411A of the covering body 141A to the first side 131A of the cloth component 13A or to drive the first zipper element 1431A to disengage from the second zipper element 133A for separating the first side 1411A of the covering body 141A from the first side 131A of the cloth component 13A. As shown in FIG. 5, the first zipper element 1431A and the second zipper element 133A can respectively surround the first ring-shaped opening structure 1415A and the first side 131A of the cloth component 13A. However, the present disclosure is not limited thereto. In another embodiment, the first zipper element and the second zipper element can respectively be disposed on a portion of the first ring-shaped opening structure and a portion of the first side of the cloth component.

As shown in FIG. 1 to FIG. 5, when it is desired to cover the four corner components 12A by the covering member 14A, a user can operate the zipper connector 1432A to drive the first zipper element 1431A to engage with the second zipper element 133A for coupling the first side 1411A of the covering body 141A to the first side 131A of the cloth component 13A, so that the first side 131A of the cloth component 13A is enclosed by the first ring-shaped opening structure 1415A. Afterwards, the second side 1412A of the covering body 141A can be flipped outwardly, and then the second side 1412A of the covering body 141A can be positioned on the second side 132A of the cloth component 13A by buckling of the first combining structure 1421A and the second combining structure 1121A, so that the second side 132A of the cloth component 13A is enclosed by the second ring-shaped opening structure 1416A. When the first side 1411A of the covering body 141A is coupled to the first side 131A of the cloth component 13A and the second side 1412A of the covering body 141A is positioned on the second side 132A of the cloth component 13A, the covering member 14A covers the four corner components 12A for preventing insertion of the child's finger into a gap between each of the corner components 12A and the corresponding handrail 111A and a gap between each of the corner components 12A and the corresponding post 112A. Therefore, the present disclosure has enhanced using safety.

Figure 6:
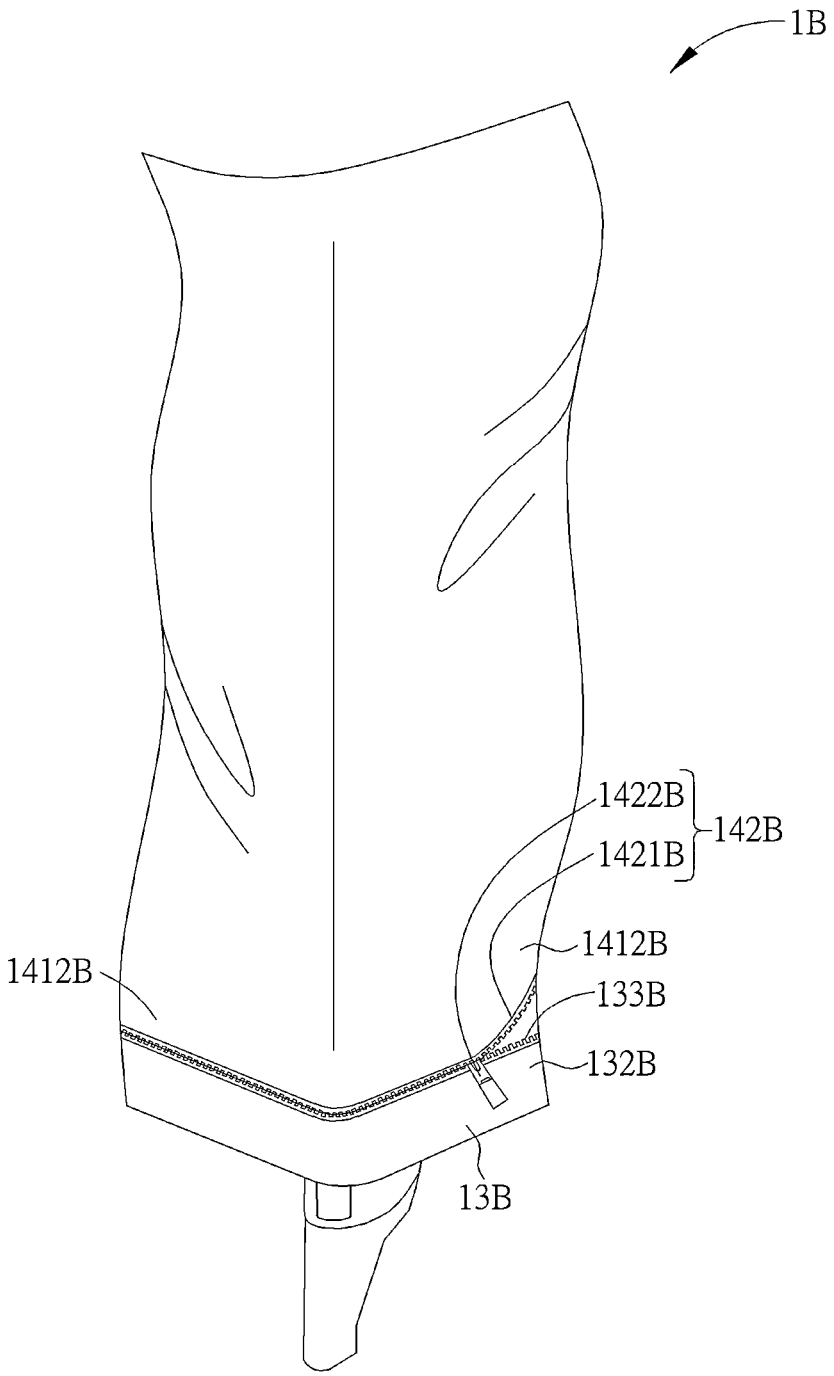
FIG. 6 to FIG. 8 are partial diagrams of child cribs according to different embodiments of the present disclosure.
Figure 7:
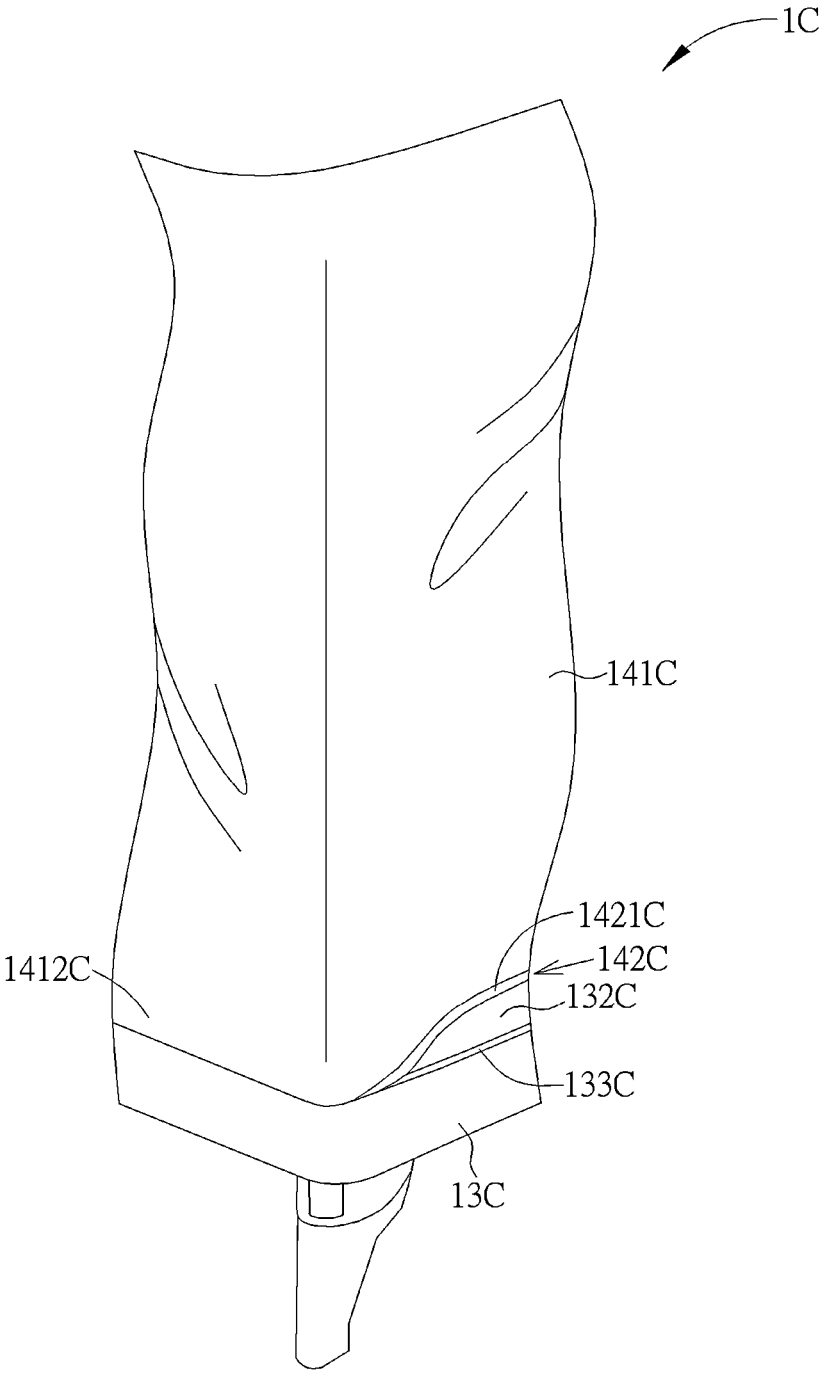
Figure 8:
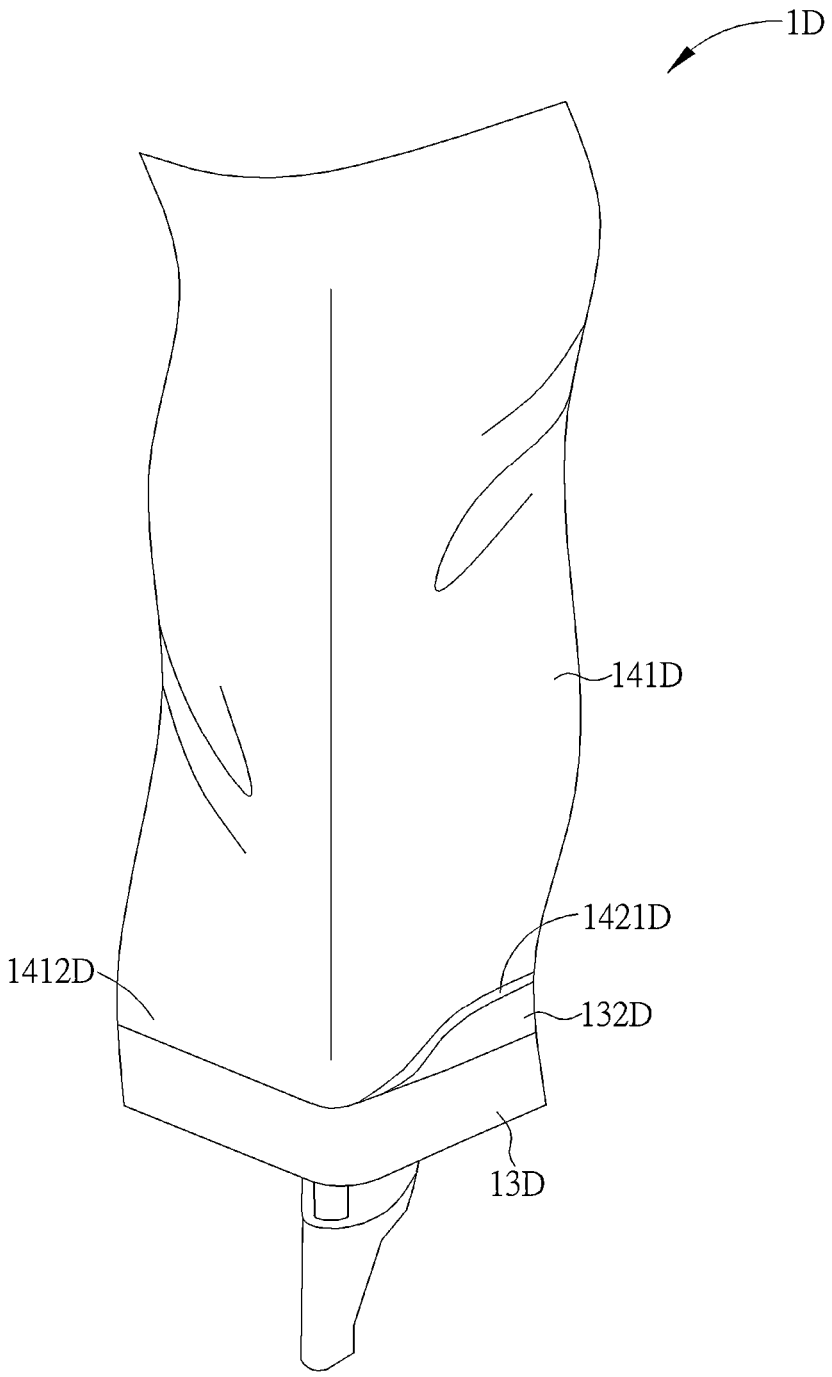

Besides, the positioning mechanism of the second side of the covering body and the second side of the cloth component is not limited to the aforementioned embodiments. For example, please refer to FIG. 6 to FIG. 8. FIG. 6 to FIG. 8 are partial diagrams of child cribs 1B-1D according to different embodiments of the present disclosure. In an embodiment of FIG. 6, a connecting assembly 142B includes a first zipper structure 1421B and a zipper fastener 1422B. The first zipper structure 1421B is disposed on a second side 1412B of a covering body 141B. A cloth component 13B includes a second zipper structure 133B disposed on a second side 132B of the cloth component 13B. The zipper fastener 1422B is configured to drive the first zipper structure 1421B to engage with the second zipper structure 133B for coupling the second side 1412B of the covering body 141B to the second side 132B of the cloth component 13B or to drive the first zipper structure 1421B to disengage from the second zipper structure 133B for separating the second side 1412B of the covering body 141B from the second side 132B of the cloth component 13B. In addition, in an embodiment of FIG. 7, a connecting assembly 142C includes a first combining structure 1421C disposed on a second side 1412C of a covering body 141C. A cloth component 13C includes a second combining structure 133C disposed on a second side 132C of the cloth component 13C. The second combining structure 133C is configured to detachably combine with the first combining structure 1421C, so as to detachably position the second the second side 1412C of the covering body 141C on the second side 132C of the cloth component 13C. Specifically, in this embodiment, the first combining structure 1421C and the second combining structure 133C can respectively be a female Velcro tape and a male Velcro tape which can be adhered to each other. In another embodiment, the first combining structure and the second combining structure also can respectively be a female buckle and a male buckle which can be buckled with each other, or respectively be an engaging hole and an engaging hook which can be engaged with each other. Moreover, in an embodiment of FIG. 8, the second combining structure can be omitted. A first combining structure 1421D disposed on a second side 1412D of a covering body 141D can detachably combine with a second side 132D of a cloth component 13D directly, so as to detachably position the second side 1412D of the covering body 141D on the second side 132D of the cloth component 13D. For example, the second side 132D of the cloth component 13D can be made of non-woven fabric material, and the first combining structure 1421D can be a male Velcro tape which can be adhered to the second side 132D of the cloth component 13D.

Figure 9:
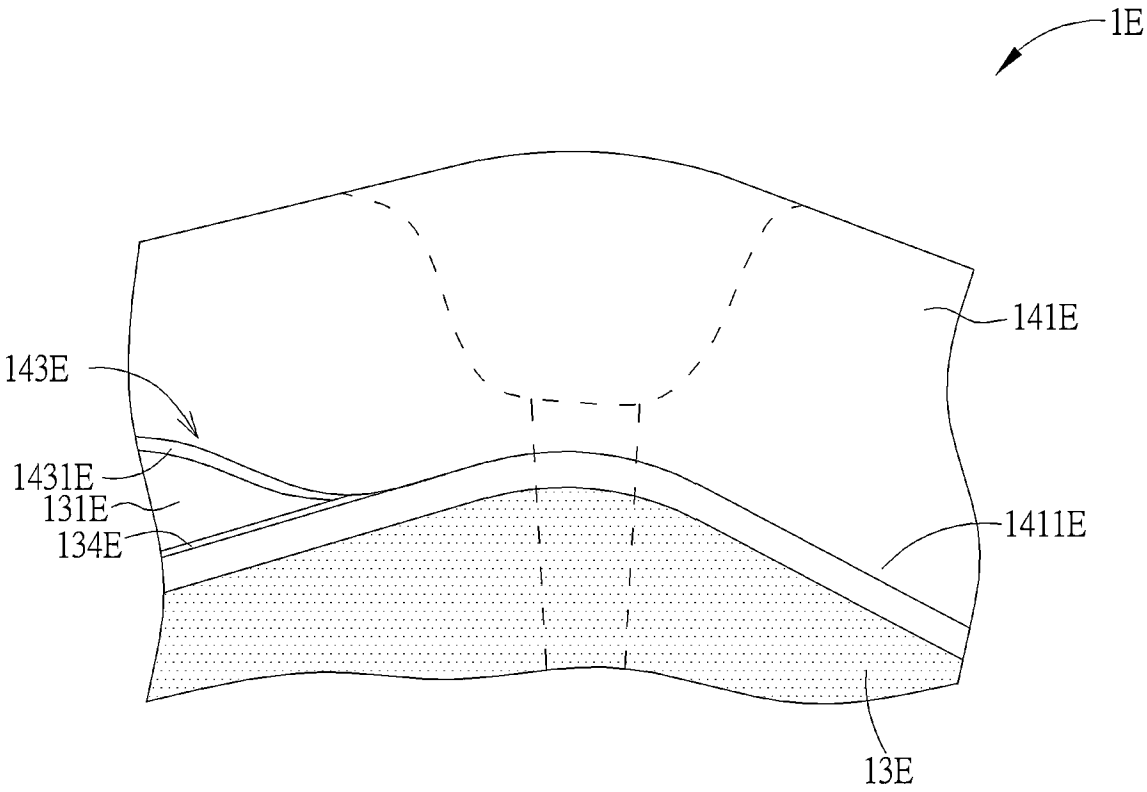
FIG. 9 to FIG. 10 are partial diagrams of child cribs according to another two different embodiments of the present disclosure.
Figure 10:
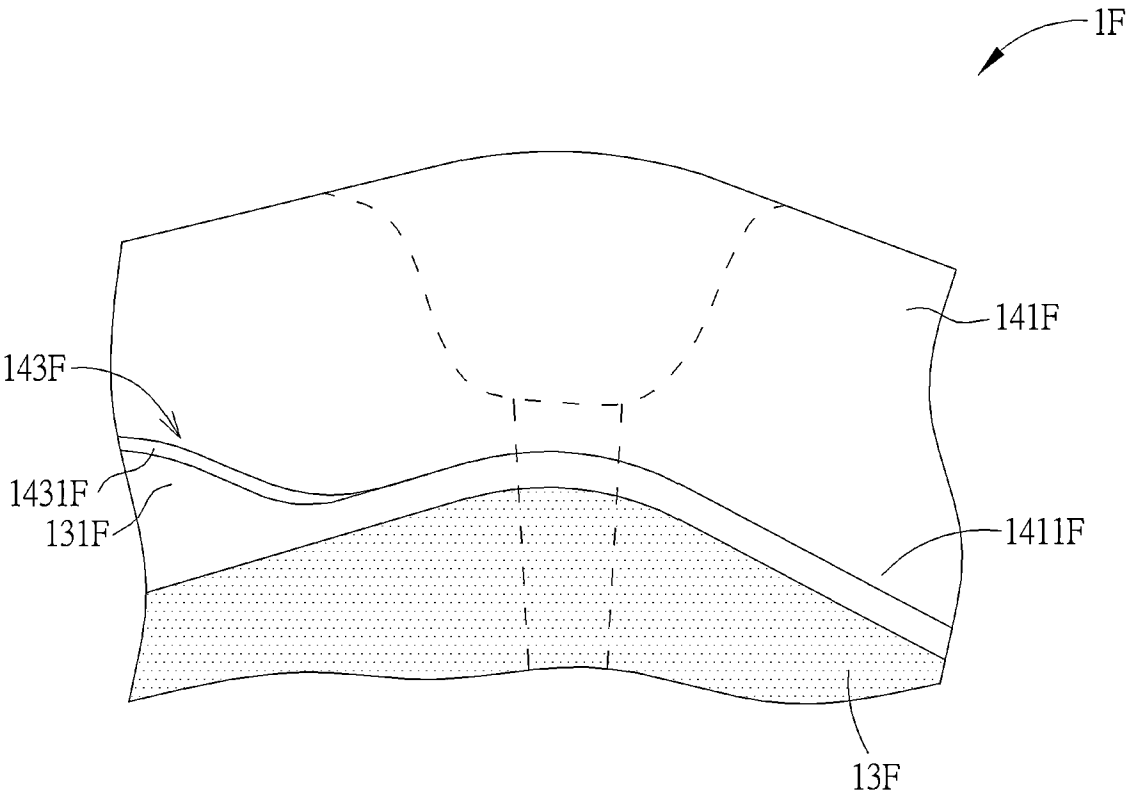

Furthermore, the connecting mechanism of the first side of the covering body and the first side of the cloth component is not limited to the aforementioned embodiments. For example, please refer to FIG. 9 to FIG. 10. FIG. 9 to FIG. 10 are partial diagrams of child cribs 1E-1F according to another two different embodiments of the present disclosure. In an embodiment of FIG. 9, a linking assembly 143E includes a first combining element 1431E disposed on a first side 1411E of a covering body 141E. A cloth component 13E includes a second combining element 134E disposed on a first side 131E of the cloth component 13E. The second combining element 134E is configured to detachably combine with the first combining element 1431E, so as to detachably couple the first side 1411E of the covering body 141E to the first side 131E of the cloth component 13E. Specifically, in this embodiment, the first combining element 1431E and the second combining element 134E can respectively be a female Velcro tape and a male Velcro tape which can be adhered to each other. However, the present disclosure is not limited thereto. The combining mechanism of the first combining element and the second combining element of the present disclosure is not limited to any form. In another embodiment, the first combining element and the second combining element also can respectively be a female buckle and a male buckle which can be buckled with each other, or respectively be an engaging hole and an engaging hook which can be engaged with each other. Moreover, in an embodiment of FIG. 10, a linking assembly 143F includes a first combining element 1431F disposed on a first side 1411F of a covering body 141F, and the second combining element can be omitted. The first combining element 1431F is configured to combine with a first side 131F of a cloth component 13F, so as to detachably couple the first side 1411F of the covering body 141F to the first side 131F of the cloth component 13F. For example, the first side 131F of the cloth component 13F can be made of non-woven fabric material, and the first combining element 1421F can be a male Velcro tape which can be adhered to the first side 131F of the cloth component 13F.

Understandably, in an embodiment, the child crib can include the positioning mechanism of the second side of the covering body and the second side of the cloth component of any one of the embodiments of FIG. 4, FIG. 6, FIG. 7 and FIG. 8, and the connecting mechanism of the first side of the covering body and the first side of the cloth component of any one of the embodiments of FIG. 5, FIG. 9 and FIG. 10.

The present disclosure utilizes the covering member to cover the corner component for preventing insertion of a child's finger into a gap between the corner component and the handrail and/or a gap between the corner component and the post. Therefore, the present disclosure has enhanced using safety.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A child crib comprising:

a frame body comprising a handrail and a post;

a corner component connected to the handrail and the post;

a cloth component at least partially covering the frame body, the corner component being exposed out of the cloth component; and a covering member comprising a covering body, the covering body comprising a first side, a second side, a third side and a fourth side, the first side of the covering body being opposite to the second side of the covering body, the third side of the covering body being adjacent to the first side and the second side of the covering body, the fourth side of the covering body being adjacent to the first side and the second side of the covering body and opposite to the third side of the covering body, the third side of the covering body being connected to the fourth side of the covering body, so that a first ring-shaped opening structure and a second ring-shaped opening structure are respectively formed by the first side of the covering body and the second side of the covering body, when the first side of the covering body is connected to a first side of the cloth component, by positioning the second side of the covering body on a second side of the cloth component, the first side and the second side of the cloth component being respectively enclosed by the first ring-shaped opening structure and the second ring-shaped opening structure, and the covering member covering the corner component, wherein the covering member further comprises a linking assembly configured to detachably couple the first side of the covering body to the first side of the cloth component, the linking assembly includes a first link element on the first side of the covering body and a second link element on the first side of the cloth component, the second link element being fixed at a position lower than the corner component in a direction perpendicular to a plane defined by the first ring-shaped opening structure, the covering member further comprises a single connecting assembly configured to detachably position the second side of the covering body on the second side of the cloth component, the single connecting assembly continuously extends along a perimeter of the child crib over the corner component, and the single connecting assembly is at a lower end portion of the covering body such that in response to the second side of the covering body being positioned onto the second side of the cloth component, an entirety of a window section of the cloth component is covered by the covering body.

2. The child crib of claim 1, wherein the single connecting assembly comprises a first zipper structure and a zipper fastener, the first zipper structure is disposed on the second side of the covering body, the cloth component comprises a second zipper structure disposed on the second side of the cloth component, and the zipper fastener is configured to drive the first zipper structure to engage with the second zipper structure for coupling the second side of the covering body to the second side of the cloth component or to drive the first zipper structure to disengage from the second zipper structure for separating the second side of the covering body from the second side of the cloth component.

3. The child crib of claim 1, wherein the single connecting assembly comprises a first combining structure disposed on the second side of the covering body, the cloth component comprises a second combining structure disposed on the second side of the cloth component, and the second combining structure is configured to detachably combine with the first combining structure, so as to detachably position the second side of the covering body on the second side of the cloth component.

4. The child crib of claim 1, wherein the single connecting assembly comprises a first combining structure disposed on the second side of the covering body, and the first combining structure is configured to detachably combine with the second side of the cloth component, so as to detachably position the second side of the covering body on the second side of the cloth component.

5. The child crib of claim 1, wherein the first link element comprises a first zipper element and a zipper connector, the first zipper element is disposed on the first side of the covering body, the second link element comprises a second zipper element disposed on the first side of the cloth component, the zipper connector is configured to drive the first zipper element to engage with the second zipper element for coupling the first side of the covering body to the first side of the cloth component or to drive the first zipper element to disengage from the second zipper element for separating the first side of the covering body from the first side of the cloth component.

6. The child crib of claim 1, wherein the first link element comprises a first combining element disposed on the first side of the covering body, the second link element comprises a second combining element disposed on the first side of the cloth component, and the second combining element is configured to detachably combine with the first combining element, so as to detachably couple the first side of the covering body to the first side of the cloth component.

7. The child crib of claim 1, wherein the first link element comprises a first combining element disposed on the first side of the covering body, and the first combining element is configured to detachably combine with the first side of the cloth component, so as to detachably couple the first side of the covering body to the first side of the cloth component.

8. A child crib comprising:

a frame body comprising a handrail and a post;

a corner component connected to the handrail and the post;

a cloth component at least partially covering the frame body, the corner component being exposed out of the cloth component; and a covering member comprising a covering body and a connecting assembly, the covering body comprising a first side and a second side, the first side of the covering body being opposite to the second side of the covering body, the connecting assembly being configured to detachably position the second side of the covering body on a second side of the cloth component, when the first side of the covering body is connected to a first side of the cloth component, the covering member covering the corner component by detachably positioning the second side of the covering body on the second side of the cloth component;

wherein the connecting assembly comprises a first combining structure disposed on the second side of the covering body, the post comprises a second combining structure disposed on a portion of the post exposed out of the cloth component, the second combining structure is configured to detachably combine with the first combining structure, so as to detachably position the second side of the covering body on the second side of the cloth component, the covering member further comprises a linking assembly configured to detachably couple the first side of the covering body to the first side of the cloth component, the linking assembly includes a first link element on the first side of the covering body and a second link element on the first side of the cloth component, the second link element being fixed at a position lower than the corner component in a direction perpendicular to a plane defined by the first ring-shaped opening structure, the covering member further comprises a single connecting assembly configured to detachably position the second side of the covering body on the second side of the cloth component, the single connecting assembly continuously extends along a perimeter of the child crib over the corner component, and the single connecting assembly is at a lower end portion of the covering body such that in response to the second side of the covering body being positioned onto the second side of the cloth component, an entirety of a window section of the cloth component is covered by the covering body.

9. The child crib of claim 8, wherein the first link element comprises a first zipper element and a zipper connector, the first zipper element is disposed on the first side of the covering body, the second link element comprises a second zipper element disposed on the first side of the cloth component, and the zipper connector is configured to drive the first zipper element to engage with the second zipper element for coupling the first side of the covering body to the first side of the cloth component or to drive the first zipper element to disengage from the second zipper element for separating the first side of the covering body from the first side of the cloth component.

10. The child crib of claim 8, wherein the first link element comprises a first combining element disposed on the first side of the covering body, the second link element comprises a second combining element disposed on the first side of the cloth component, and the second combining element is configured to detachably combine with the first combining element, so as to detachably couple the first side of the covering body to the first side of the cloth component.

11. The child crib of claim 8, wherein the first link element comprises a first combining element disposed on the first side of the covering body, and the first combining element is configured to detachably combine with the first side of the cloth component, so as to detachably couple the first side of the covering body to the first side of the cloth component.

* * * * *